United States Patent [19]

Galaspie

[11] 4,297,617

[45] Oct. 27, 1981

[54] LIGHT PRODUCING DEVICE

[76] Inventor: Charles E. Galaspie, Rte. 1, Box 353, Bumpass, Va. 23024

[21] Appl. No.: 132,742

[22] Filed: Mar. 24, 1980

[51] Int. Cl.[3] ..... H01J 61/30; H05B 41/26

[52] U.S. Cl. ..... 315/326; 313/202; 313/220; 315/209 R

[58] Field of Search ..... 315/326, 209 R, 348, 315/352; 313/202, 220, 221

[56] References Cited

U.S. PATENT DOCUMENTS

| | | | |
|---|---|---|---|
| 2,064,354 | 12/1936 | Prouty | 313/220 |
| 2,479,164 | 8/1949 | Inman | 313/188 |
| 2,644,113 | 6/1953 | Etzkorn | 313/220 |
| 2,716,712 | 8/1955 | Alexander | 313/202 |
| 4,143,303 | 3/1979 | Goble | 315/352 |

FOREIGN PATENT DOCUMENTS

| | | | |
|---|---|---|---|
| 85487 | of 1958 | Denmark | 313/221 |

*Primary Examiner*—Eugene R. LaRoche
*Attorney, Agent, or Firm*—Norman B. Rainer

[57] ABSTRACT

A device is provided comprised of an elongated flexible transparent thermoplastic tube which confines an electrically excitable gas, and an electrical supply which generates a pulsed direct current of high peak voltage and feeds said current to an electrode entered into one end of said tube, whereby said tube is caused to emit visible light and is capable of undergoing movement while emitting light.

7 Claims, 4 Drawing Figures

LIGHT PRODUCING DEVICE

BACKGROUND OF THE INVENTION

This invention relates to a light producing device comprising a flexible elongated tube, and more particularly to a device comprising a flexible tube which produces visible light and can be readily bent to form various shapes, and moved while emitting light.

The use of neon-filled glass tubes for producing light in advertising displays and other applications is well known. Although neon lighting installations can give the impression of movement by the sequential activation of adjacent tubes, the glass tubes are inherently rigid and incapable of movement.

Attempts to devise flexible lighting devices which might be otherwise similar to neon-filled glass tube systems have been disclosed in U.S. Pat. No. 2,644,113 to Etzkorn, U.S. Pat. No. 2,064,354 to Prouty, and elsewhere. Such devices, although achieving some measure of flexibility, involve complex multi-component light-producing structures, and have required modes of electrical activation which either restrain the ultimate mobility of the system or require high energy consumption.

It is accordingly an object of the present invention to provide a flexible elongated light-producing tube of simple construction capable of operation by an electrical supply which imposes minimal restraint upon the movement of said tube.

It is another object of this invention to provide a tube of the aforementioned nature operated by an electrical supply in a manner to require relatively little energy consumption.

These objects and other objects and advantages of the invention will be apparent from the following description.

SUMMARY OF THE INVENTION

The above and other beneficial objects and advantages are accomplished in accordance with the present invention by the provision of an improved light producing device which comprises an elongated flexible transparent tube containing an electrically excitable gas, and an electrical supply which associates with one end of said tube.

The elongated tube is preferably of uniform circular cross section, having a length to diameter ratio in excess of 20 and preferably in excess of 100. The flexibility of the tube is such that both ends can be readily brought to closely adjacent juxtaposition, thereby placing the tube in a generally circular configuration. The walls of the tube are impervious to gas and are of a thickness such that the tube will resist collapse under a pressure gradient of 760 mm Hg pressure between the interior and exterior of the tube. The transparency of the tube is of a nature such that a significant percentage of the light generated within the tube will be transmitted through the wall of the tube.

Both ends of the tube are sealed to prevent gas leakage. Confined within the tube is a gas such as neon, methane, argon, helium or the like capable of electronic excitation to a light-emitting state at confinement pressures of 1 to 7 mm Hg. One end of said tube is provided with a pointed metal electrode positioned on the center axis of the tube and thermally insulated from the wall thereof.

The electrical supply is designed to accept either current from a low voltage step-down transformer (110V to 10V) or from a six to twelve volt battery to power an automotive type spark coil. The voltage output of the spark coil may be characterized as a pulsating direct current having a peak voltage between 20,000 and 50,000 volts. Other systems such as solid state automotive ignition power supplies with a Schmidt trigger may alternatively be utilized. Said output current is supplied by electrical conductor to said electrode, whereupon the gas confined within said tube is caused to emit visible light in all directions by a manner of electronic excitation which causes the gas to be amenable to deflection by a magnetic field.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
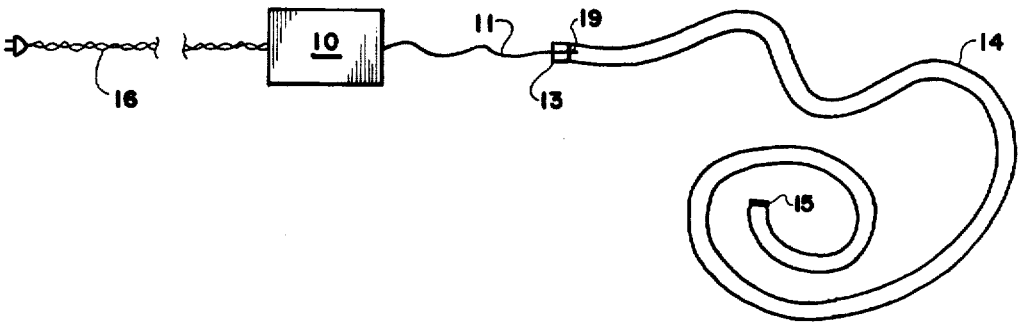
FIG. 1 is a schematic representation of an embodiment of light producing device of the present invention.

Referring to FIG. 1, a light producing device of this invention is shown consisting of an electrical supply 10, joined by an electrical conductor 11 to electrode 19 inserted into the proximal end 13 of flexible tube 14 which terminates at a sealed distal end 15.

Figure 3:
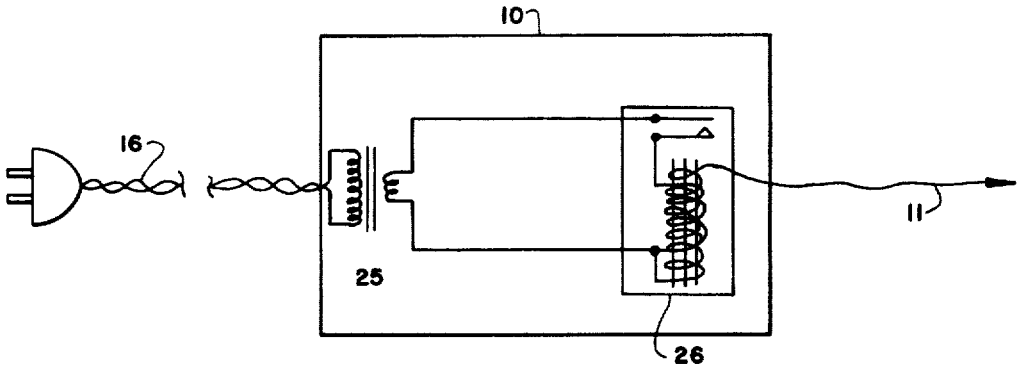
FIG. 3 is a schematic diagram of the electrical circuitry of the electrical supply utilized in the embodiment of FIG. 1.
Figure 4:
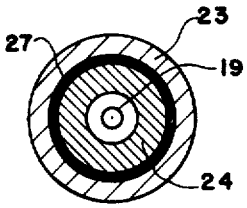
FIG. 4 is a sectional view taken along the line 4—4 of FIG. 2.

A source of electrical power, not shown, transmits input electrical energy through power supply cord 16 to electrical supply 10. Said input electrical energy is preferably alternating current having a frequency of about 60 cycles per second, and a peak voltage of about 110 volts. Input electrical energy of other forms, such as low voltage direct current from batteries can however be fed into the electrical supply. The electrical supply shown in FIG. 3 is comprised of a stepdown transformer 25 which causes 110 volt A.C. input current to be transformed to 10 volts AC current. Said transformed, low voltage current is led into interrupter 26 or equivalent component of electrical supply 10 which causes the low voltage current to be converted into a pulsed direct current, the frequency of pulses being between about 30 and 100 pulses per second, and the peak voltages being between 20,000 and 50,000 volts. The input electrical energy thus modified by the electrical supply leaves said electrical supply as an output electrical energy having a peak amperage between about 0.5 and 50 milliamps and preferably between 1 and 25 milliamps. Said output electrical energy is conducted away from electrical supply 10 to the proximal end 13 of flexible tube 14 by electrical conductor 11.

Figure 2:
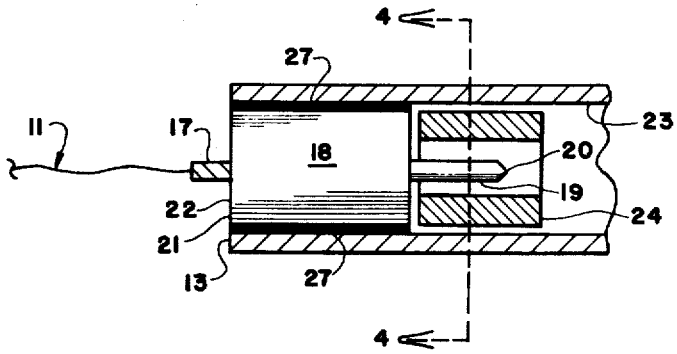
FIG. 2 is an enlarged fragmentary sectional view of the electrode-containing end of the flexible tube of FIG. 1.

As shown in FIG. 2, electrical conductor 11 attaches to the outer terminal 17 of metal plug 18 seated within the proximal end of flexible tube 14. A metal electrode 19 in electrical communication with plug 18, is centered within tube 14, and terminates in a pointed tip 20. The electrode is fabricated of a metal having a melting point above 1000° C., a preferred metal being tungsten. The perimeter 21 of outer face 22 of plug 18 is sealed to the flexible tube in a manner so as to prevent passage of gas through the space between plug 18 and the inside surface 23 of said tube. Said sealing may be achieved by use of resinous materials 27 which can be supplied in fluid state and then hardened in situ, or by causing said tube, by thermal treatment, to contract into tight engagement with plug 18, or by other means.

A protective sleeve 24 is coaxially disposed about said electrode in close-fitting engagement with the inside surface 23 of said tube. The function of the sleeve is to protect the tube from heat generated by the electrode during operation of the light producing device. Suitable materials of construction of said sleeve include high melting plastics such as Teflon, a polytetrafluoroethylene produced by the E. I. DuPont Company of Wilmington, Del., and other materials which can reflect, absorb or otherwise dissipate heat.

The flexible tube 14 is preferably produced by the extrusion of a transparent, flexible thermoplastic polymer composition in an annular configuration. The wall thickness of the tube should be adequate to withstand collapse under a pressure gradient of one atmosphere. Smaller tube diameters will require lesser wall thicknesses for adequate strength. A particularly preferred tube of extruded transparent flexible thermoplastic material useful in the practice of this invention is Tygon, a plasticized polyvinylchloride tubing produced by the Norton Company of Worcester, Ma. Other suitable tubes may be made from silicone resins and certain copolymers of butadiene and acrylonitrile. In general, polymers possessing the requisite transparency for satisfactory utilization in the fabrication of the tubes useful in the present invention will have a substantially amorphous mophological structure.

The distal end 15 of flexible tube 14 is sealed to prevent passage of gas. Sealing may be accomplished by resinous sealants, by thermal closure of said tube, by insertion of a tight-fitting plug, or by other equivalent techniques. Prior to the sealing of said distal end, a desired gas or gas mixture is entered into tube 14 at a desired subatmosphere pressure. In general, the pressure of the gas confined within the flexible tube will be within the range of 1 to 7 mm Hg. The exact value for optimal functionality is dependent upon the specific characteristics of the output electrical energy, the nature of the gas, and the internal diameter and length of the flexible tube. In general, higher electrical voltages, lower gas pressures and smaller tube diameters tend to produce greater amounts of visible light.

When the proper combination of values of the several parameters is established, a continuous column of visible light is created within the flexible tube, and said light is emitted through the wall of said tube. The color of the light may be modified primarily by adjustment of the nature of the gas or gas mixture. For example, residual air produces white light; neon produces orange or red light; hydrogen produces pink light; and methane produces a bluish light. Further modifications in the color of the light produced by the device may be achieved by using tubing having a specific coloration, as may be obtained by pigmentation of the polymer utilized to produce the flexible tube, or by the application of colored coatings to the tube.

Although not wishing to be bound by theoretical explanations, it is felt that the confined gas within the flexible tube is caused to emit light because of the critically selected nature of the gas, its pressure, and the special electronic excitation provided by the electrical supply. The device of the present invention, which utilizes only a single electrode, differs in kind from analogous devices of the prior art which require two electrodes or two poles to achieve an electrical discharge or complete an electrical circuit. Because only one electrode is herein utilized, it does not impose any restraint upon movement of the flexible tube, nor does it require elaborate electrically conductive members coextensively disposed within said tube. The actual efficiency of light production of the device of this invention is dependent upon the specific nature of gas utilized and its pressure, the dimensions of the flexible tube, the thickness and light transmittance of the tube wall, and the output electrical energy applied to the tube. The flexible tube of the present invention may have a length greater than ten feet, although such lengths will required output electrical energy having peak voltages in the upper region of the 20,000 to 50,000 volt range already delineated.

The state of the confined gas during its emission of light is such that it can be visibly deflected by a magnetic field. Although such phenomenon suggests a flow of electrical current, it must be noted that there is no concerted, unidirectional flow of electrical current within the stagnant confined gas. The gas remains at ambient temperature during its light-emitting excitation. The exact value of said ambient temperature exerts no significant effect upon the function of the device.

The following example illustrates a preferred embodiment of this invention and is not intended to limit the invention in any manner.

EXAMPLE 1

An electrical supply was assembled by utilizing a step down transformer which converts 110 volt, 60 cycle alternating current to 10 volt, 60 cycle alternating current. The low voltage electrical current emerging from the transformer enters an interupter-type spark coil, model 1957, made by the KW Company. The output current from the coil is a pulsed direct current having 60 pulses per second, each pulse having a symmetrical spiked configuration having a peak intensity of 20,000 volts. The amperage of said output current is ½ milliamps, measured by a voltage drop across a series resistor.

Said output current is transferred by a single wire conductor to a pointed tungsten electrode which protrudes from a metal plug sealing the proximal end of a flexible tube. The electrode extends ½ inch into the open space of said tube along the longitudinal axis thereof. A circular sleeve fabricated of Teflon and having a wall thickness of 3 mm is fitted in abutment with the interior wall surface of said tube and extends the same distance as said electrode into the tube.

Said flexible tube is Tygon, an extruded plasticized polyvinylchloride product of the Norton Company of Worcester, Ma. The inside diameter of the tube is 9 mm, the wall thickness is 3 mm, and its length is 305 cm. The tube confines neon gas at a pressure of 1 mm Hg. The distal end of the tube is sealed with an air-curing silicone resin.

When the system is activated by causing said output current to communicate with said electrode, the entire length of the tube lights up with uniform intensity. Under said conditions of operation the electrical consumption is 20 watts. While emitting light, the tube is cool to the touch and can be manipulated into many different curvilinear configurations extending in three spatial dimensions.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A light producing device comprising an elongated flexible transparent thermoplastic tube having sealed proximal and distal ends and containing an electrically excitable gas, and an electrical supply which associates with said proximal end, said tube having a substantially uniform cross sectional configuration along its length, a length to diameter ratio in excess of 20, a flexibility such that said ends can be readily brought into contact, a wall thickness capable of resisting collapse of said tube under a pressure gradient of one atmosphere, and a transparency such that a significant percentage of the light generated within said tube will emerge through the wall of said tube, said electrically excitable gas being a mono or polyatomic gas or gas mixture at a pressure of between about 1 and 7 mm Hg., said electrical supply providing an output current which is a pulsed direct current of sub-ampere intensity having a peak voltage between 20,000 and 50,000 volts and a pulse frequency of about 60 pulses per second, said output current being directed by a single electrical conductor to a pointed metal electrode protruding through the proximal end of said tube and coaxial therewith, and thermal shielding means annularly disposed between said electrode and the adjacent wall of said tube.

2. The device of claim 1 wherein said tube is comprised of plasticized polyvinylchloride.

3. The device of claim 1 wherein said electrical supply is operated from an input current which is 6 to 12 volts direct current.

4. The device of claim 1 wherein said electrical supply comprises an interrupter-type spark coil capable of being operated by an electrical input current of 6 to 12 volts.

5. The device of claim 1 wherein said output current is of less than 25 milliamps.

6. The device of claim 1 wherein the confined gas, during the emission of light, can be visibly deflected by a magnetic field and remains at ambient temperature.

7. The device of claim 6 wherein the electrode associated with the proximal end of said tube is the only electrode associated with said tube.

* * * * *